US005092222A

United States Patent [19]

Lynch

[11] Patent Number: 5,092,222

[45] Date of Patent: Mar. 3, 1992

[54] FLOAT UP SYSTEM FOR SUBMARINE LAUNCHED MISSILES

[75] Inventor: Robert A. Lynch, San Diego, Calif.

[73] Assignee: General Dynamics Corporation, Convair Division, San Diego, Calif.

[21] Appl. No.: 295,959

[22] Filed: Aug. 26, 1981

[51] Int. Cl.[5] ..... F41F 3/07

[52] U.S. Cl. ..... 89/1.809; 89/1.81

[58] Field of Search ..... 114/125, 312, 316–319, 114/322, 323, 326–329, 330, 331, 333, 336; 102/341, 406; 89/1.809, 1.81; 441/1, 7, 9, 21, 28, 29, 30, 32, 33

[56] References Cited

U.S. PATENT DOCUMENTS

| | | | |
|---|---|---|---|
| 3,093,033 | 6/1963 | Draim | 89/1.809 |
| 3,137,203 | 6/1964 | Brown | 89/1.81 |
| 3,242,810 | 3/1966 | La Pointe | 89/1.810 |
| 3,279,319 | 10/1966 | Semonian | 89/1.81 |
| 3,954,059 | 4/1976 | Langseth | 102/341 |

*Primary Examiner*—David H. Brown

*Attorney, Agent, or Firm*—John R. Duncan; Frank D. Gilliam

[57] ABSTRACT

A "float-up" launching system for launching missiles from submerged submarines or other submerged launchers utilizing a lightweight rigid cylindrical tube telescoped over the missile while stored in the launcher so as to not take up additional volume. On launching, the tube is extended forward of the missile by a gas generator to form a floatation chamber which creates extra buoyance forward of the missile center of gravity, but still connected to the water surface, nose upwardly, where it is disconnected and the missile booster is ignited.

9 Claims, 3 Drawing Sheets

FIG. A

FLOAT UP SYSTEM FOR SUBMARINE LAUNCHED MISSILES

BACKGROUND OF THE INVENTION

This invention relates, in general, to missile launching systems and related, specifically, to systems for launching missiles from submerged submarines or other submerged launchers.

Submarine torpedo tubes and other launchers have limited volume and the missiles that they contain are dense and have a negative buoyancy. Therefore, the missiles are boosted to the surface by rocket motors. Underwater booster motors are, of necessity, of special design having low thrust and low expansion ratio. These underwater boost requirements tend to be incompatible with the subsequent in-air boost phase and this incompatability leads to complex designs requiring dual thrust boosters. Furthermore, the boost motors become more complex as launch depth flexibility (shallow and deep) requirements increase.

Floatation systems to simplify the underwater boost requirements have been proposed by which the missile is floated to the surface where the in-air booster motors are ignited and the missile launched. These prior art floatation systems have either been rigid floatation capsule systems which took up too much volume, were heavy and complex, and resisted deep submergence pressures, or fabric floatation devices which did not provide the rigidity needed to maintain good missile control especially during high speed torpedo tube ejection.

Accordingly, it is a primary object of this invention to improve the prior art floatation systems by providing a float up system which is compact and lightweight for launching missiles from submerged submarines or other launchers.

SUMMARY OF THE INVENTION

The launching system which meets the foregoing principle object comprises a float up system which utilizes a simple lightweight rigid cylindrical tube which fits the missile closely while in storage so as to not take up additional volume and which is extended forward of the missile on launching by a small gas generator, either in the float assembly or in the missile nose, to form a floatation chamber which creates an extra buoyance well forward of the missile center of gravity but still connected to the missile nose thus causing the missile to rise to the surface nose upward in a very controlled manner. At or near the surface the float capsule is disconnected and either jettisoned or retracted on to the missile.

The foregoing system, as will be seen from the more detailed description hereinafter, is quiet and thus minimizes the possibility of alerting enemy submarines. The rocket motor necessary to boost the missile from the shallow depth to which the float up system has brought the missile is optimized for in-air performance. Many of these missiles must also operate from surface ships, and the shallow depth booster is directly applicable to such a surface launch. Thus, the same type missiles can be used for surface as well as deep or shallow submerged launch.

Other and additional advantages and objects of the invention will become apparent to those skilled in the art after a study of the following drawings and detailed description set forth hereinafter.

BRIEF DESCRIPTION OF THE DRAWINGS

FIG. A represents the trajectory of the launched missile and floatation capsule of the invention.

DETAILED DESCRIPTION

FIG. A and FIGS. 1–5 should be considered together since FIG. A shows the trajectory of the float-up system comprising this invention launched from a submerged launcher, such as in a submerged submarine, with the numbers in FIG. A representing the various stages of the launch and represented by corresponding Figure numbers.

Figure 1:
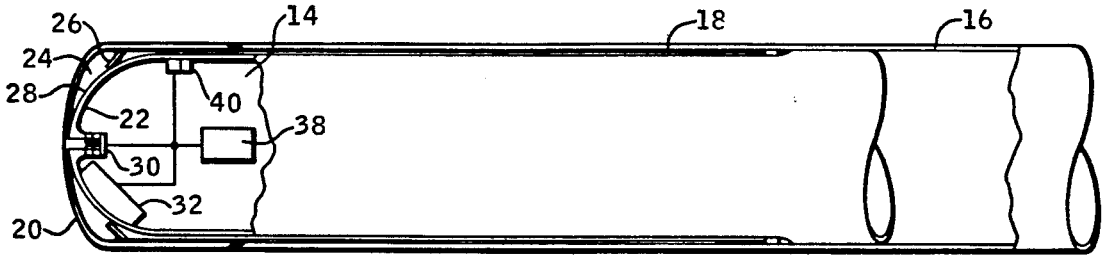
FIGS. 1–5 illustrates the operation of the float-up system constructed in accordance with the teachings of the invention.

Thus, before describing the details of the invention, it can be seen that FIG. 1 shows a missile encapsulated in a floatation chamber as it would be stored for launching from a submarine torpedo tube or other launchers. The entire system requires substantially the same volume as would be taken up by the normal missile without such a floatation system which, it can be appreciated, is a definite advantage of the invention.

Figure 2:
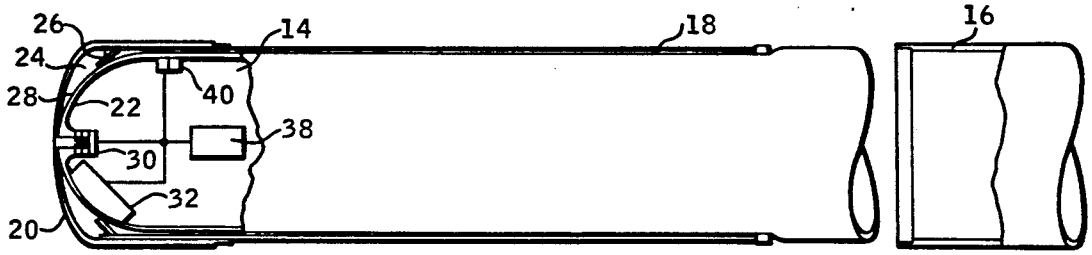

FIG. 2 shows the missile and floatation chamber launched together from the launcher.

Figure 3:
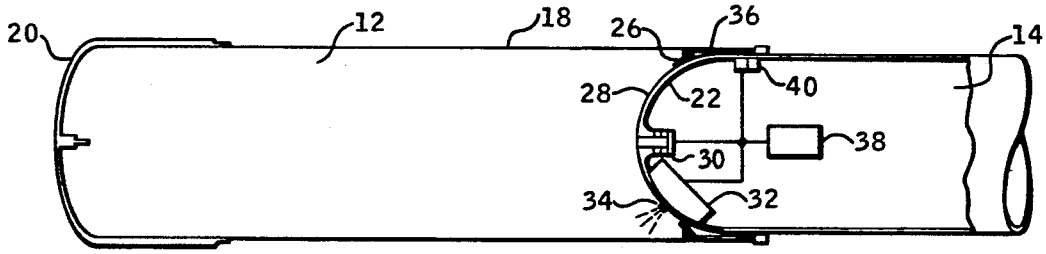

FIG. 3 illustrates the expanded floatation chamber extending beyond the nose of the missile so as to direct the nose of the missile upward toward the surface.

Figure 4:
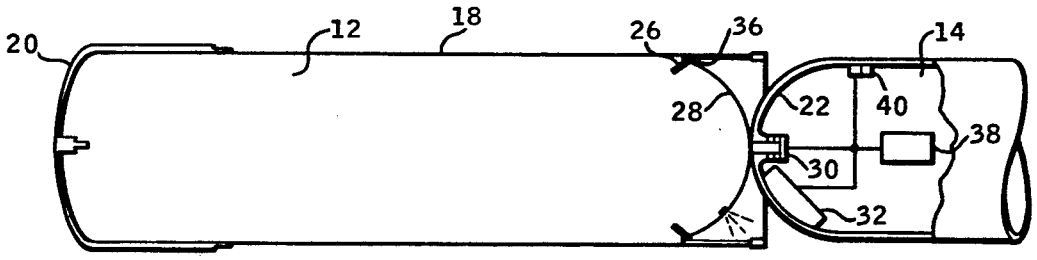

FIG. 4 illustrates the detachment of the floatation chamber from the missile with floatation chamber changing it's direction so as to not interfere with the missile path of travel.

Figure 5:
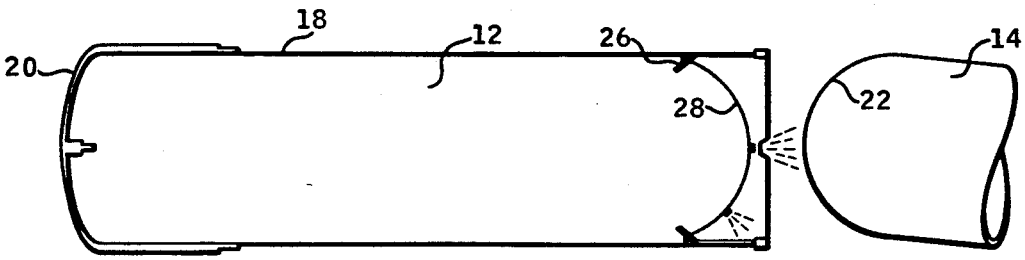

And finally FIG. 5 illustrates the floatation chamber separate from the missile and floating on the surface with the missile now being launched from a shallow depth and airborne as shown in FIG. A.

To accomplish the foregoing float-up launch of the invention, attention is now directed more specifically to FIGS. 1–6 which contain the details of the system and the manner in which the encapsulated missile and floatation chamber act together.

The float-up system comprises a floatation chamber 12, shown retracted in FIGS. 1 and 2, telescoped over a missile 14 and thereby completely encapsulating the missile nose both of which are installed in a capsule or launching tube 16. The floatation chamber 12 is formed by an elongated rigid tube 18 which terminates in a concavo-convex front end wall 20 closing the front end of said tube and which generally conforms to the blunt front end or nose 22 of the missile 14. The outer peripheral area of said end wall is spaced out from the nose, as at 24, to accomodate a rigid support ring 26 which supports a flexible diaphragm 28 located between the inner side of the front wall 20 and the nose 22. This flexible diaphragm 28 conforms to the nose 22. This flexible diaphragm 28 and its supporting ring 26 remain contiguous to the nose of the missile while stored in the capsule or launching tube yet forms, effectively, a movable back wall of the floatation chamber and, as such, allows the floatation chamber comprising the front wall 20, the tube 18 and the back wall (flexible diaphragm) to be telescoped over the missile while stored, thus permitting the system to be stored in approximately the same volume as would be taken up by the missile alone.

After launching from the capsule, as shown in FIG. 2, a source of gas under pressure, such as from gas generator 32, (in this embodiment located within the missile) provides gas pressure through an orifice 34 in the diaphragm sufficient to extend the tube 18, that is, move the front end wall forward of the nose of the missile separating it from the nose and diaphragm until the ring 26 supporting the diaphragm engages a stop means (ring) 36 located near the end of the floatation chamber tube 18. Of course, at the same time the gas generator 32 is activated, the floatation chamber nose release mechanism 30 is actuated to allow the front end wall 20 to separate from the missile nose 22. This actuation is accomplished through a guidance logic means 38 connected thereto.

Also located within the missile nose 22 are a plurality of floatation restraint assemblies 40 or attachment means 40 which engage the supporting ring 26 and allow the gas pressure to build up within the chamber 12 to a predetermine level after the supporting ring 26 engages the stop means. This relationship or condition exists while the floatation chamber and missile are traveling missile nose upwardly, toward the water surface. The guidance logic means 38, to which the restraint assemblies are connected, senses the depth of the missile, among other things. The assemblies are then actuated and, under the influence of the pressure in the floatation chambers, the flexible diaphragm 28 reverses its curvature and the chamber is separated from the missile. Note that the missile's negative buoyancy is overcome by the positive buoyancy of the floatation chamber and when the floatation chamber is extended, the missile's center of gravity is such that the missile nose is directed upwardly. The floatation chamber 12 is attached to the missile nose in the three places around the periphery of the stop ring. There attachments are released under the control of the guidance logic which effectively determines depth. Orifices 34 and 42 in the diaphragm direct the released float assembly away from the missile. Since the missile is at or near the surface of the water and the floatation chamber is clear of the path of travel of the missile travel, the missile booster motors are ignited to boost the missile into its aerodynamic flight.

Figure 6:
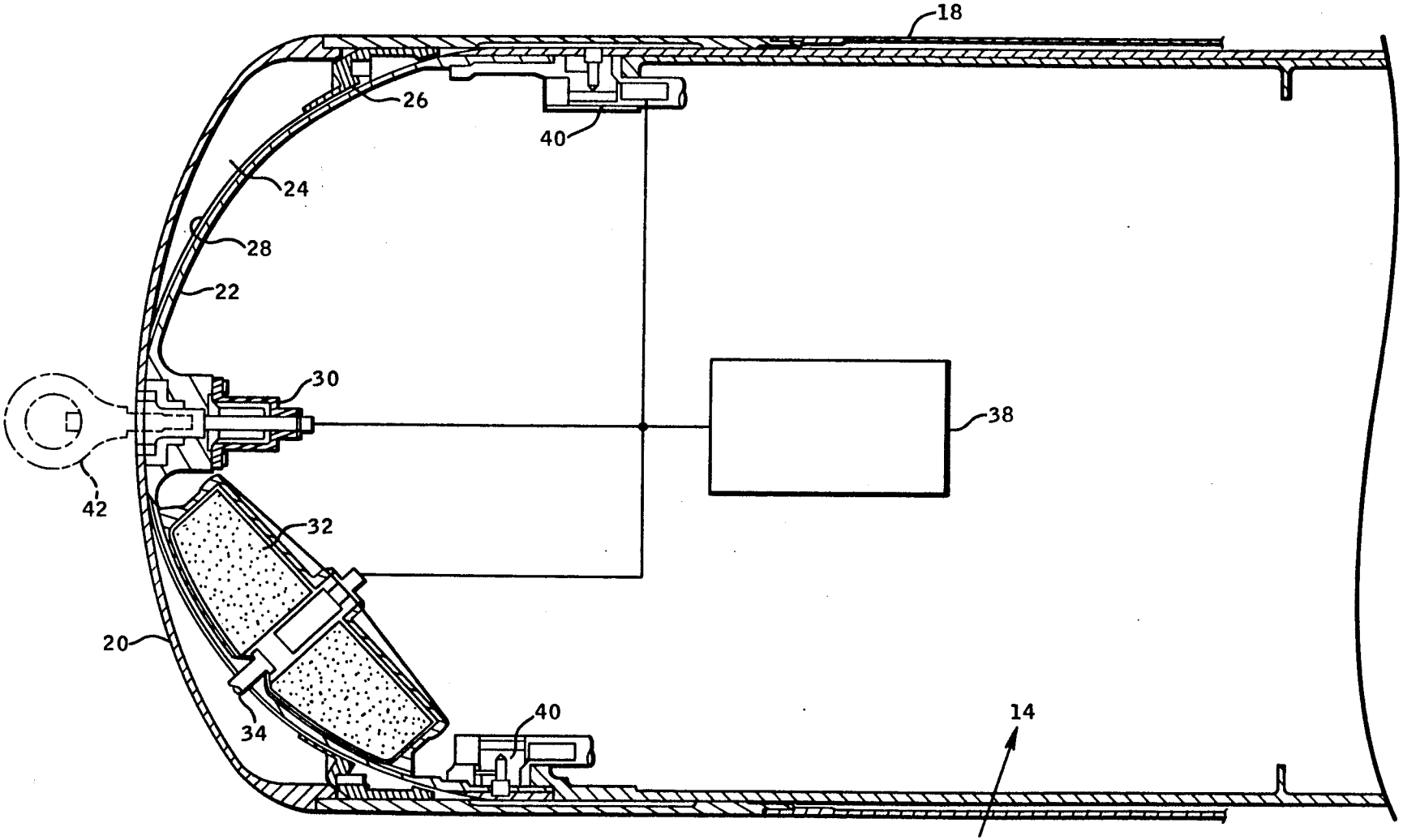
FIG. 6 is a cross-sectional view of a portion of the float-up system, enlarged over FIGS. 1–5 to illustrate certain details more clearly.

Turning now specifically to FIG. 6, where the details of the system are more fully disclosed, it can be seen that the floatation restraint assembly 40 includes a pin and the nose release assembly 30 includes a piston both of which are actuated by the guidance logic 38. These assemblies 30 and 40 as well as the means to actuate the pressure chamber 32 are not described in detail since any suitable assemblies which would perform their function could be selected by those skilled in the art once having understood this invention.

Figure 7:
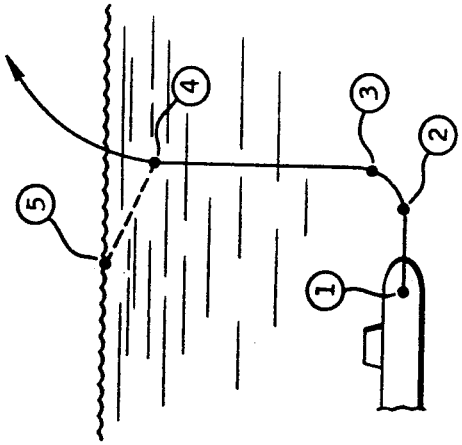
FIG. 7 illustrates an alternative form of float-up system from that of FIGS. 1–5.
Figure 7:
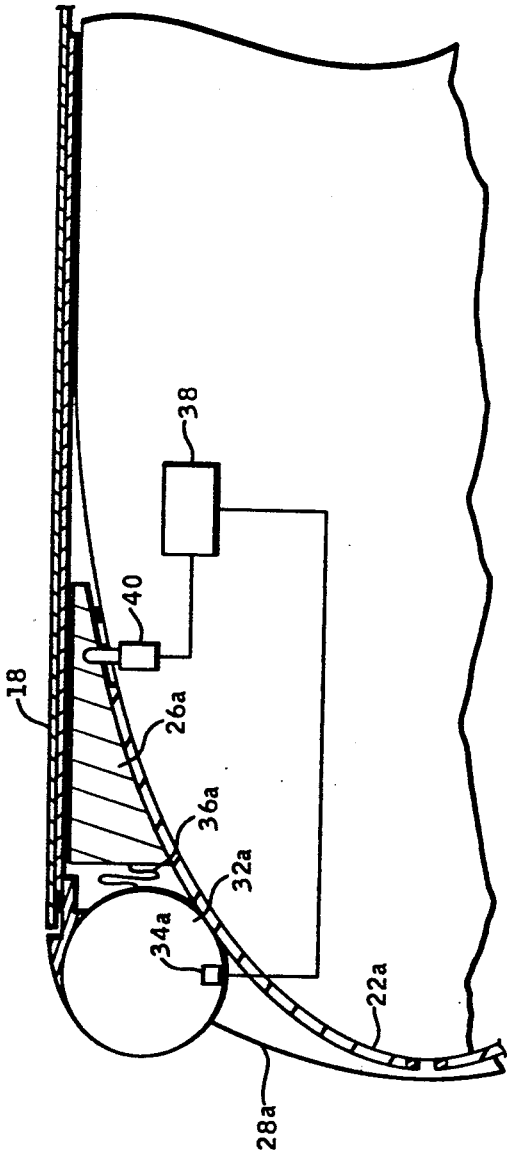
Figure 8:
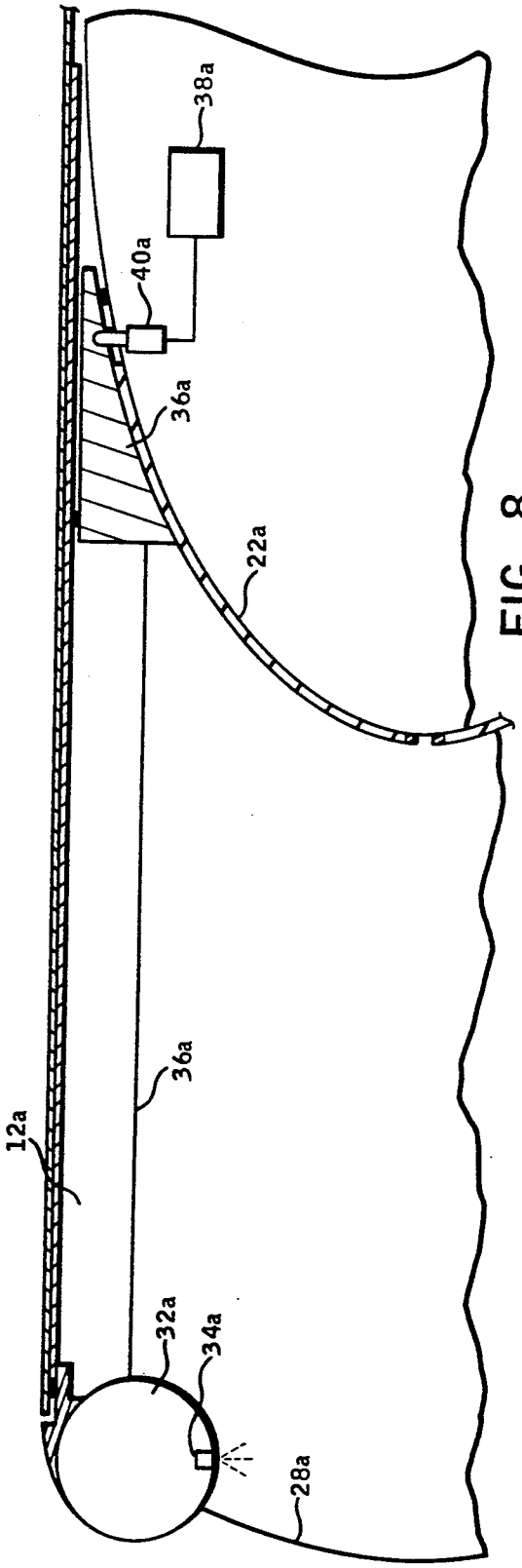
FIG. 8 illustrates the extended position of the floatation chamber of FIG. 7.

FIG. 7 shows an alternative embodiment with the pressure source **32*a* located outside the missile but inside the floatation chamber 12*a*. In this embodiment, also the stop means 36*a* is in the form of a plurality of cables of suitable length to stop the support ring 26*a* at the preselected position, as shown in FIG. 8, rather than engaging the stop means in the form shown in the preceding embodiment. It is to be noted that a plurality of O-ring type seals 50 are used between the outer tube 18*a* and the forward end wall and this system also has the restraint system 40*a* which is connected to the support ring 26*a* and which is under the control of the guidance logic means 38*a*** as in the prior configurations.

Again, at the appropriate time after launching, the gas pressure chamber **32*a* is actuated to emit gas into the floatation chamber 12*a* to cause the frontwall 28*a* to move from the missile nose 22*a* thereby forming a floatation chamber 12*a* as in the prior embodiments until the stop means (cables) 36*a*** are fully extended. Thereafter, the guidance logic means actuates the restraint assemblies as in the prior embodiment to accomplish the launch near the surface.

What is claimed is:

1. A float-up system for a missile adapted to be launched from a launcher submerged in a body of water comprising;

a floatation chamber including a elongated cylinder closed at one end to form an end wall and which is telescoped over the missile, a flexible wall movable within said elongated cylinder and disposed between the nose of said missile and the inside surface of said closed end, said flexible wall forming the other end of said floatation chamber, means for connecting said flexible wall to said missile nose, and means for introducing gas under pressure between said closed end wall and said flexible end wall to cause said closed end wall to move in a direction away from said flexible wall to form said floatation chamber which tilts the nose of said missile upwardly and provides buoyancy for the missile so as to lift said missile nose upwardly toward the surface of said water.

2. The float-up system as claimed in claim 1 wherein said flexible wall has a supporting ring which is slidable within the inner wall of said elongated cylinder, and stop means located near one end of said cylinder and engagable by said support ring to prevent further movement of said movable flexible wall during the time that said gas is introduced under pressure.

3. The float-up system as claimed in claim 2 wherein said stop means comprises block means.

4. The float-up system as claimed in claim 2 wherein said stop means comprises cable means.

5. The float-up system as claimed in claim 2 including restraining means connecting said missile to said flexible wall and for engaging and restraining outward movement of said missile from said cylinder as said missile nose is moved toward the surface of said water, means for activating said restraining means to disengage said missile from the flexible wall and from said cylinder, said disengagement forming an orifice in said flexible wall which reacts against said water to move said floatation chamber out of the path of said missile.

6. The float-up system as claimed in claim 5 wherein said means for introducing gas under pressure also forms an orifice in said flexible wall which together with said prior mentioned orifice serve to direct the missile during its separation from said missile.

7. A float-up launching system for floating a missile having a negative buoyancy to the surface of a body of water from a submerged launcher including a floatation chamber which when filled with gas under pressure tilts the nose of said missile upwardly and lifts said missile towards the surface of said body of water:

said floatation chamber comprising;

an elongated hollow cylindrical cylinder which telescopes over the body of the missile when stored in said launcher and which is provided with a closed end forming the front wall of said floatation chamber, and a flexible wall slidable within said chamber and located between the inner surface of the front end wall and the nose of said missile and movable by the introduction of said pressure into the space between said inner surface of said front wall and said flexible wall, the introduction of said pressure causing said cylinder and front end wall to move away from said flexible wall and said missile nose, said float-up system further including;

means for restraining the floatation chamber with respect to said missile until the latter is at or near the surface of said body of water, and means for deactivating said restraining means to separate said missile and floatation chamber so that said missile is free to begin an airborne flight.

8. The float-up system as claimed in claim 7 wherein said restraining means forms a means by which the pressure in said floatation chamber acts to separate said floatation chamber from said missile.

9. The float-up system as claimed in claim 8 wherein said restraining means also determines the position of the missile with respect to the floatation chamber so that the position of the nose of the missile is upwardly directed.

* * * * *